US006696958B2

(12) United States Patent
Anderson

(10) Patent No.: US 6,696,958 B2
(45) Date of Patent: Feb. 24, 2004

(54) METHOD OF DETECTING A FIRE BY IR IMAGE PROCESSING

(75) Inventor: Kaare Josef Anderson, Burnsville, MN (US)

(73) Assignee: Rosemount Aerospace Inc., Burnsville, MN (US)

( * ) Notice: Subject to any disclaimer, the term of this patent is extended or adjusted under 35 U.S.C. 154(b) by 40 days.

(21) Appl. No.: 10/047,097

(22) Filed: Jan. 14, 2002

(65) Prior Publication Data

US 2003/0132847 A1 Jul. 17, 2003

(51) Int. Cl.[7] ..... G08B 17/12
(52) U.S. Cl. ..... 340/578; 348/164
(58) Field of Search ..... 340/578, 577, 340/584; 348/164–168; 250/339.15

(56) References Cited

U.S. PATENT DOCUMENTS 4,408,224 A * 10/1983 Yoshida ..... 348/164
4,520,390 A * 5/1985 Paredes et al. ..... 348/164
5,153,722 A 10/1992 Goedeke et al. ..... 348/159
5,289,275 A * 2/1994 Ishii et al. ..... 340/578 X
5,510,772 A * 4/1996 Lasenby ..... 340/578
5,592,151 A * 1/1997 Rolih ..... 340/584
5,677,532 A * 10/1997 Duncan et al. ..... 250/339.15
5,777,548 A * 7/1998 Murakami et al. ..... 340/578 X
5,937,077 A * 8/1999 Chan et al. ..... 340/578 X
6,184,792 B1 * 2/2001 Privalov et al. ..... 340/578
6,278,374 B1 * 8/2001 Ganeshan ..... 340/578
6,335,976 B1 * 1/2002 Belmares ..... 348/155 X

* cited by examiner

*Primary Examiner*—Thomas J Mullen
(74) *Attorney, Agent, or Firm*—James M. Rashid; Calfee, Halter & Griswold LLP

(57) ABSTRACT

A method of detecting a fire in a scene by infrared (IR) radiation image processing comprises the steps of: receiving a sequential plurality of IR radiation images of the scene, each image including an array of picture elements (pixels), each pixel having a value that is representative of the pixel's portion of IR radiation intensity in the array of the scene image; identifying a region of pixels in one image based on pixel values; tracking the region through images subsequent the one image to determine a change of the region that meets predetermined IR radiation criteria; and detecting the fire in the scene based on the determined change of the region. In one embodiment, the step of tracking includes the steps of: identifying the region in images subsequent the one image; and comparing the identified regions of the one and subsequent images to determine a change of the region that meets the predetermined IR radiation criteria. In another embodiment, the step of detecting the fire includes the steps of: identifying the region in sequential images of a predetermined period of time subsequent the one image; comparing the identified regions of the one and sequential images to determine motion changes of the region; calculating a motion value of the region based on the determined motion changes thereof; and determining fire of a certain type based on the motion value of the region.

19 Claims, 3 Drawing Sheets

METHOD OF DETECTING A FIRE BY IR IMAGE PROCESSING

BACKGROUND OF THE INVENTION

The present invention relates to detecting fires by image processing, in general, and more particularly, to a method of detecting a fire in a scene by infrared (IR) radiation image processing.

Currently, there are many different methods for detecting fires. One method includes monitoring a predetermined area of interest with an IR radiation detector or an ultraviolet (UV) radiation detector or a combination of the two. Each detector receives the total radiation from the area of interest and generates an electrical signal representative of the total radiation received which may in turn be compared to a threshold value. Exceeding the threshold value by one or more of the detectors generally causes an alarm to be generated that indicates fire is present in the area of interest. While this method detects fires adequately, it is vulnerable to detecting radiation from objects or regions that are not fires and causing undesirable false alarms.

To reduce the number of false alarms, recent fire detection systems have become more sophisticated. Some systems, like the system disclosed in U.S. Pat. No. 5,153,722, entitled "Fire Detection System" and issued Oct. 6, 1992, for example, use image processing of video color image frames of a viewed area to detect one or more regions of fire therein. More specifically, images from the visible light camera are evaluated to identify bright regions which are tracked through sequential frames to determine if any of these regions meet the criteria of a fire event. IR and UV detectors are used to confirm a fire event. Accordingly, fires in the viewed area are determined with a high degree of accuracy.

These visible light camera systems are well suited for large, open air environments in which smoke and other fire byproducts do not obscure the visible images of the camera. However, for fire detection in enclosed areas like cargo bays of aircraft, for example, smoke may quickly fill the enclosed area and prevent the detection of an underlying fire. It is further possible for fog or mist which may be present in aircraft cargo bays due to the environment around the plane to obscure the visible images and prevent the detection of an underlying fire. Even in clean air environments, visible light camera systems may not detect a smoldering fire before it bursts into flames. Also, if a fire commences within the contents of a box or container, it may not be detected by visible image processing until the box or container itself bursts into flames or the flames of the fire escape the box or container, and in these cases, the fire would be permitted to reach a dangerous stage before detection. Accordingly, only flames can be detected using visible light camera systems. Thus, a smoldering fire in a box or container which never reaches the flaming stage may not be detected or confirmed.

The present invention is directed to a method of detecting fires through image processing which overcomes the drawbacks of the present methods, especially for enclosed areas, and provides for distinguishing between types of fires.

SUMMARY OF THE INVENTION

In accordance with one aspect of the present invention, a method of detecting a fire in a scene by infrared radiation image processing comprises the steps of: receiving a sequential plurality of infrared radiation images of the scene, each image including an array of picture elements (pixels), each pixel having a value that is representative of the pixel's portion of infrared radiation intensity in the array of the scene image; identifying a region of at least one pixel in one image of the plurality of images of the scene based on pixel values; tracking the region through images of the plurality subsequent the one image to determine a change of the region that meets predetermined infrared radiation criteria; and detecting the fire in the scene based on the determined change of the region. In one embodiment, the step of tracking includes the steps of: identifying the region in images of the plurality subsequent the one image; and comparing the identified regions of the one and subsequent images to determine a change of the region that meets the predetermined infrared radiation criteria. In another embodiment, the step of detecting the fire includes the steps of: identifying the region in sequential images of a predetermined period of time subsequent the one image; comparing the identified regions of the one and sequential images to determine motion changes of the region; calculating a motion value of the region based on the determined motion changes thereof; and determining fire of a certain type based on the motion value of the region.

In accordance with another aspect of the present invention, the method includes the steps of: identifying a plurality of regions of at least one pixel in one image of the plurality of images of the scene based on pixel values; tracking each region of the plurality through images of the plurality subsequent the one image to determine at least one region of the plurality having a change that meets predetermined infrared radiation criteria; and detecting the fire in the scene based on the at least one region having the determined change.

DETAILED DESCRIPTION OF THE INVENTION

Figure 1:
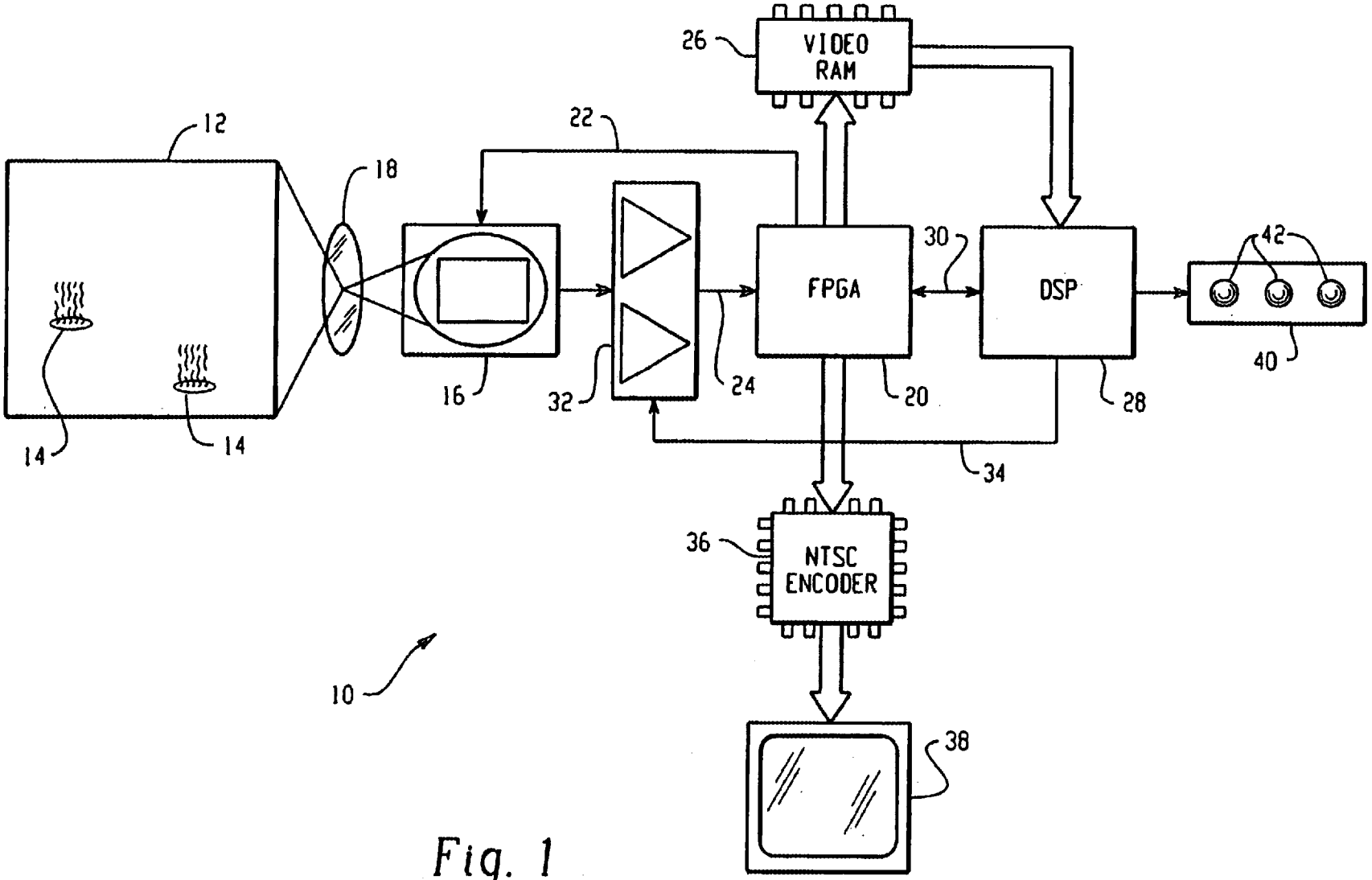
FIG. 1 is a block diagram illustration of an exemplary IR radiation image processing system 10 suitable for embodying the principles of the present invention.

FIG. 1 is a block diagram illustration of an exemplary IR radiation image processing system 10 suitable for embodying the principles of the present invention. Referring to FIG. 1, the system 10 is adapted to view an area or scene 12 which may include one or more hot spots or regions 14 that could be or result into fire events. The system 10 includes an image generator 16 for viewing and generating sequential IR radiation images of the scene 12 at a predetermined rate. In the present embodiment, the generator 16 comprises a focal plane array of the microbolometer type which responds to IR radiation in the wavelength range of 8–12 microns, for example. But, it is understood to all those skilled in the pertinent art that this range is merely a design choice and a larger or smaller range, or even other IR radiation ranges, may be chosen without deviating from the broad principles of the present invention. The focal plane array 16 is controlled to capture and generate frames of images of 320×240 picture elements (pixels) at a frame rate of approximately 30 frames per second. Each pixel of an image may be scaled and digitized with a range of eight (8) bits binary or 0 to 255 grey scale format to represent its portion of IR radiation intensity in the array of the scene image 12. It is further understood that image processing could be performed with higher or lower resolution images or with a smaller or larger range of grey scale values just as well.

Alternatively, an IR camera which may be of the type manufactured by Infrared Components Corporation, for example, may be included in the image generator 16 to produce a standard National Television Standards Committee (NTSC) video frame output. In this alternate embodiment, a conventional frame grabber would be further included in the generator 16 to sample the video output of the IR camera and extract 320×240 pixel array images from the video frames thereof at a rate of 30 frames per second, for example. It is understood that the pixel array and frame rate of the present embodiments are merely described by way of example and that other pixel arrays and frame rates may be chosen as desired for particular applications.

One or more lenses 18 are disposed between the scene 12 and array 16 to focus the field of view or scene 12 onto the array 16. In the present embodiment, the lens or lenses 18 are adapted to be transparent to radiation in the 8–12 micron wavelength region and include a wide field of view preferably on the order of 110 degrees, for example. But, it is understood that the size of the field of view will be determined primarily on the specific application of the system.

Further, in the present embodiment, a field programmable gate array (FPGA) 20 is coupled to the array 16 and programmed with digital logic to control the array 16 over signal lines 22 and to assemble sequential images of the scene 12 from an incoming pixel stream generated by the array over signal lines 24 and to store the assembled images in a memory 26 which may be a conventional video random access memory (RAM), for example, until a programmed digital processing unit 28 is ready to process the images. As indicated herein above, the images of the present embodiment comprise arrays of 320×240 pixels having intensity values which range from 0–255 or eight bits. Thus, the higher the pixel value, the greater the IR radiation intensity captured and generated by the image generator 16. In addition to the video RAM 26, the processor 28 may also be coupled to the FPGA 20 over signal lines 30 to direct the digital processing operations thereof. In the present embodiment, the processor 28 may be a digital signal processor (DSP) of the type manufactured by Texas Instruments bearing model number TMS320C6414, for example.

An automatic gain controller 32 may be coupled in the signal lines 24 between the array 16 and FPGA 20 for adjusting brightness and contrast of the pixel stream of images generated by the array 16 prior to being assembled by the FPGA 20. The DSP 28 may be coupled to the controller 32 over signal lines 34 for directing the brightness and contrast settings in the adjustment thereof. However, it is understood that the brightness and contrast settings may be held substantially constant in some applications. In addition, a conventional NTSC encoder 36 may be included in the system 10 to convert the incoming IR radiation images from lines 24 via the FPGA 20 to a format for displaying on a standard display monitor 38 in visible grey scale images. Still further, system 10 may also include an alarm display 40 with a plurality of alarm lamps 42, for example. The alarm lamps 42 may be lit in combination to provide indications of certain determined states of the system 10. For example, the lamps when lit or not lit in combination may represent the states of: (0) all clear, (1) hot spots or regions present, (2) a smoldering fire detected at a region, (3) a flaming fire detected at a region, and (4) a washout, which states will become more evident from the description found herein below.

In accordance with present invention, the DSP 28 is programmed with an algorithm which is designed to detect the presence of a fire in the field of view or scene of the IR radiation image generator 16 in real time, based on the output IR radiation image frames thereof, and distinguish between a smoldering and flaming fire. In the present embodiment, the algorithm is programmed in C programming language for execution by the Texas Instrument DSP 28. This algorithm assumes that the 8-bit pixel values of the generated images are proportional to the intensity of IR radiation incident on the corresponding pixels that make up the generator's focal plane array. One frame image of the pixel stream generated by the generator 16 is processed per iteration of the algorithm to search for, identify and segment into regions certain pixels based on a statistical pixel intensity threshold determined from the pixels of the image being processed. Thus, each region containing pixels of an intensity value greater than the intensity threshold, or high intensity pixels, may be assigned a different tracking identification index or number within the image which is used to identify where to search for the same region or object in subsequent images generated by the generator 16, i.e. tracking the region through subsequent images. In this manner, regions of high intensity pixels or hot regions may be tracked over time while certain predetermined characteristics of each hot region are determined in each iteration of the algorithm.

In the present embodiment, characteristics such as the region's average pixel intensity, the number of high intensity pixels making up the region, the location of the region's centroid within the image, and a value representative of the magnitude and frequency of motion within the region are determined with each iteration of frame image processing. The motion value may be based on an analysis of all image frames comprising a predetermined period of time, like one second, for example, which may be on the order of 30 image frames for the present embodiment. Other characteristics of the regions could be determined as well. These characteristics represent criteria for determining through analysis whether or not the region represents a fire event and the type of fire event, i.e. smoldering or flaming. More specifically, based on analysis of any of the identified region's determined characteristics, the algorithm will output one of several alarms or states of the system following each iteration. If the determined characteristics of a region meet certain predetermined criteria, a fire event is determined and an alarm is issued. For example, if one or more of the hot regions are found to be consistently increasing in size and average pixel value, and if their centroids' locations remain substantially stationary a fire alarm event is indicated.

Also, if an identified region meets the aforementioned fire event criteria and the motion value calculated therefor exceeds a predetermined motion threshold value, the fire event is considered flaming and a representative fire alarm indication is issued to the alarm display 40 in the form of lighting a predetermined combination of alarm lamps 42. Alternatively, if the identified region meets the aforementioned criteria of a fire event and the motion value calculated therefor is below the predetermined motion threshold value, then the fire event is considered smoldering and a representative fire alarm indication is issued to the alarm display in the form of lighting a different predetermined combination of alarm lamps 42. Other output states which may be generated by the algorithm indicate that: (1) no hot spot regions are identified (all clear), (2) one or more hot regions have been identified, but none meet the aforementioned fire event criteria (hot spots present), or (3) more than a certain percentage of the scene, like ten percent (10%), for example, is identified as a hot spot or region (camera washout or malfunction).

The characteristics determined by the algorithm of the present embodiment are indicative of natural characteristics of fire. For example, in general, a typical fire tends to: grow in size as time passes, especially soon after the fire's inception which is the period of time during which detection is most desirable; cause increasingly intense infrared radiation to be emitted, with the largest increase occurring soon after the fire begins; stay at the location at which it begins; and exhibit a good deal of motion, especially in the form of flickering if it is a flaming fire. Accordingly, the process of analyzing these characteristics of an identified region and their trends over time, i.e. tracking through subsequent images, is intended to prevent false alarms, that is, alarms that would normally result from identified hot objects or regions other than fires which do not pose the risks generally associated with a fire.

Also, analyzing these characteristics through IR radiation image processing permits the analysis to continue even through conditions of smoke or other fire byproducts, fog, mist and the like, i.e. conditions which would normally obscure visible light image processing. In addition, because IR radiation image processing focuses on heat detection, it can detect a smoldering fire before it bursts into flames, and detect a fire hidden in a box or container well in advance of when the box or container itself bursts into flames or when the flames escape the box or container. IR image processing can detect the fire even if the fire remains hidden in the box or container and does not burst into flames.

Figure 2A:
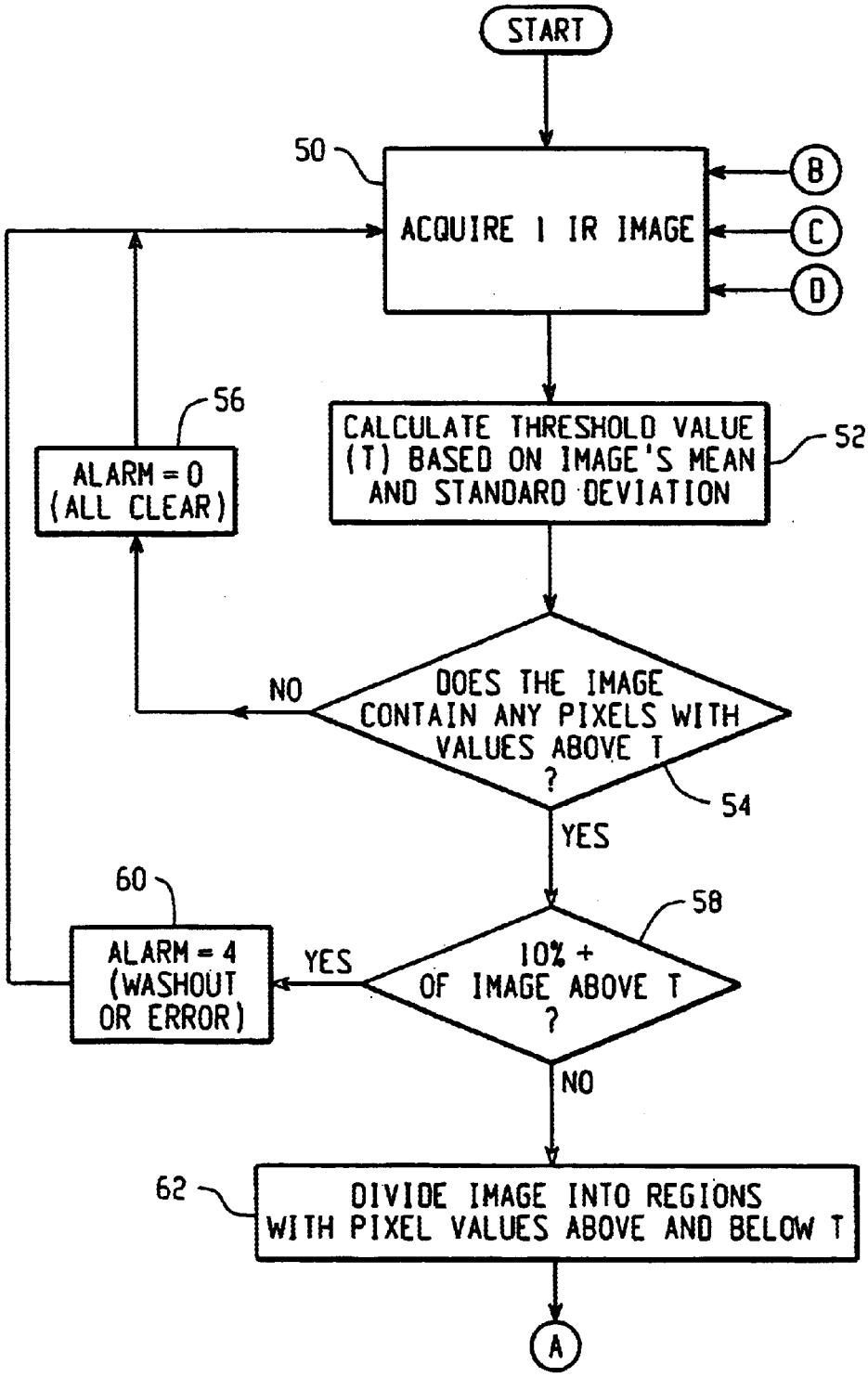
FIGS. 2A and 2B depict an exemplary program flow chart of a fire detection algorithm suitable for execution in the digital processor of the embodiment of FIG. 1.
Figure 2B:
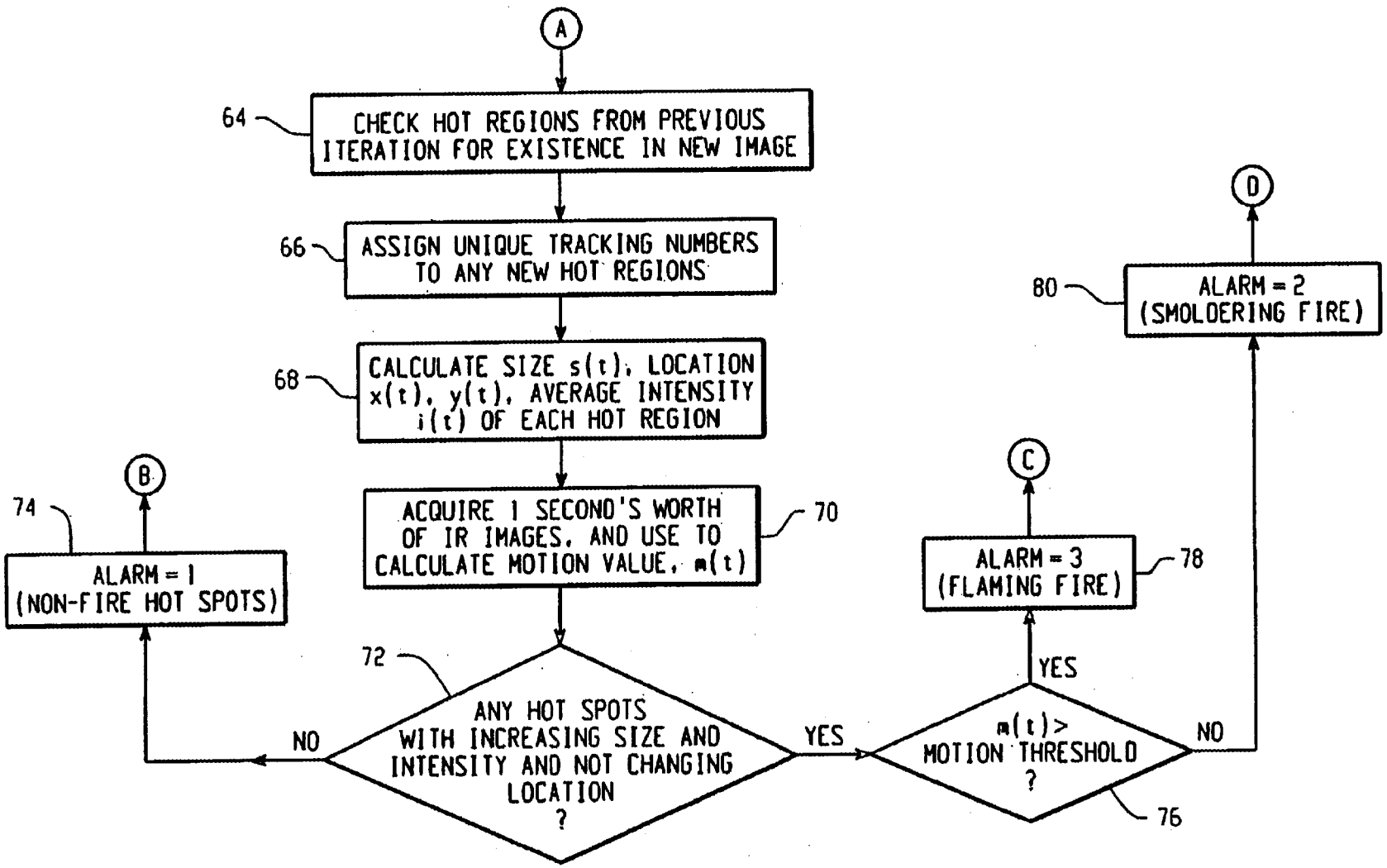

An example of such a fire detection algorithm for execution in the DSP 28 is illustrated by the program flow chart of FIGS. 2A and 2B. Referring to FIGS. 2A and 2B, the program starts at block 50 wherein the DSP 28 acquires one image frame or array of pixels from the video RAM 26 in which it had been stored. Next, in block 52, the program calculates an image threshold value T from the intensity values of the pixels of the acquired image. In the present embodiment, the threshold T is calculated based on the mean of the intensity values of the pixels or the standard deviation thereof or a combination of the two. Thereafter, in decision block 54, the program determines if any of the pixels exceed the threshold T, i.e. high intensity pixels. If not, the all clear state is issued by block 56 which causes the representative combination of lamps 42 to be lit on the alarm display 40. If there are high intensity pixels in the acquired image, then in decisional block 58 it is determined if more than 10% of the pixels (it is possible for this percentage figure to be revised or changed as desired) are high intensity. If so, a washout state is issued by block 60 which causes the representative combination of lamps 42 to be lit on the alarm display 40. If a lesser percentage of high intensity pixels are determined to be present in the acquired image, processing continues at block 62 wherein the image is segmented or divided into regions of high intensity pixels, referred to as hot regions, by grouping those pixels determined to have an intensity value greater than the threshold T, high intensity pixels, which are adjacent to each other in the image array, for example. Program execution continues at block 64 in FIG. 2B.

Referring to FIG. 2B, in block 64, the program checks the identified hot regions of the instant acquired image with the hot regions of a previously acquired image by block 50 for the existence of new regions. Of course, if the instant acquired image is the first image to be acquired in a series, then all of the identified regions would be considered new. Next, in block 66, each of the new regions are assigned an unique index or number which represents its location in the array of the image. Thereafter, in block 68, certain characteristics including the size s(t), the centroid location x(t), y(t), and the average intensity i(t) are calculated for each of the identified regions of the instant image indexed as t. Then, in block 70, the sequential frame images comprising a predetermined period of time are used to calculate a motion value, m(t), for each of the hot regions identified in the instant acquired image. As indicated herein above, the present embodiment uses a frame rate of 30 frames per second. Accordingly, thirty (30) sequentially generated frame images are used for the calculation of the motion value, m(t), in block 70.

More specifically, in block 70, the next image in sequence to the instant image is acquired from the memory 26. Regions which were identified in the instant image are compared between the next and instant images for movement. In the present embodiment, the total number of pixels of commonly located or indexed regions of the two images are subtracted from each other to obtain a pixel difference for each region and the absolute values of these pixel differences represent incremental motion values for the identified regions of the present set of two images. Each incremental motion value of the present set of images is stored temporarily. Then, the next image in the sequence of thirty images is acquired and compared with the previously acquired image of the sequence in the same manner and the incremental motion values of the regions of the instant set of images are added respectively to the incremental motion values previously calculated to produce an accumulated motion value for each identified region. Then, the next set of images is processed in the same way. In this manner, all thirty frame images are processed to yield an accumulated motion value for each of the identified regions thereof and the final accumulated motion values of the identified regions become the motion values, m(t), of the regions for the instant iteration of the algorithm.

In the present embodiment, decisional block 72 determines if the calculated characteristics of size (number of pixels) and intensity (average value of pixels) change between commonly indexed hot spots or regions of the instant acquired image by block 50 and of an image acquired by block 50 in the previous iteration of the algorithm, and if so, whether the changes in size and intensity are beyond the thresholds set therefor and then, determines if the centroid locations of the commonly indexed regions between the two images stay within the set boundaries therefor. If the aforementioned criteria are not met by any of the identified regions between images acquired by block 50 in sequential program iterations, then a non-fire hot spots state is determined and the representative combination of lamps 42 are lit on display 40 by block 74. Otherwise, at least one region is determined to have met the fire event criteria in block 72 so that program execution continues for the instant iteration at block 76 wherein it is determined if the motion value m(t) calculated by block 70 for each hot spot or region meeting the fire event criteria is greater than the predetermined motion threshold value. If so, the fire event is considered a flaming fire and the representative combination of lamps 42 are lit on the display 40 by block 78. If not, the fire event is considered a smoldering fire and the representative combination of lamps 42 are lit on the display 40 by block 80. After execution of blocks 74, 78 or 80, program execution continues at block 50 to initiate another iteration of the program. In this manner, regions having common indexes in the arrays of subsequently generated images are tracked and their characteristics compared to determine a change in the region that meets predetermined IR radiation fire event criteria. A fire event determination may also be used as a factor to determine whether or not a fire suppressant material should be used to extinguish the fire.

While the present invention has been described by way of example in connection with one or more embodiments herein above, it is understood that such embodiments should in no way, shape or form limit the present invention. Rather, the present invention should be construed in breadth and broad scope in accordance with the recitation of the claims appended hereto.

What is claimed is:

1. Method of detecting a fire in a scene by infrared radiation image processing, said method comprising the steps of:

receiving a sequential plurality of infrared radiation images of the scene;

generating for each said image an array of picture elements (pixels);

determining for each pixel a value that is representative of the pixel's portion of infrared radiation intensity in the array of the scene image;

determining a threshold value from the values of the pixels of at least one image;

identifying a region of at least one pixel in one image of the plurality of images of the scene by comparing the values of the pixels of the one image to the determined threshold value;

tracking said region through images of the plurality subsequent said one image to determine a change of said region that meets predetermined infrared radiation criteria; and detecting the fire in the scene based on the determined change of said region.

2. The method of claim 1 including the step of assigning pixels having values above the threshold value and in close proximity to each other in the one image array to the region.

3. The method of claim 1 wherein the step of determining a threshold value includes the steps of: calculating a mean value of the pixel values of the one image; and determining the threshold value based on the calculated mean value.

4. The method of claim 1 wherein the step of determining a threshold value includes the steps of: calculating a standard deviation value of the pixel values of the one image; and determining the threshold value based on the calculated standard deviation value.

5. The method of claim 1 wherein the step of tracking includes the steps of:

identifying the region in images of the plurality subsequent the one image; and comparing the identified regions of the one and subsequent images to determine a change of the region that meets the predetermined infrared radiation criteria.

6. The method of claim 5 wherein the step of comparing includes the step of comparing the identified regions of the one and subsequent images to determine the change of the region that meets the predetermined infrared radiation criteria based on the average pixel values of the region.

7. The method of claim 5 wherein the step of comparing includes the step of comparing the identified regions of the one and subsequent images to determine the change of the region that meets the predetermined infrared radiation criteria based on the number of pixel values in the region that are above a high intensity value.

8. The method of claim 5 wherein the step of comparing includes the step of comparing the identified regions of the one and subsequent images to determine the change of the region that meets the predetermined infrared radiation criteria based on a location of the centroid of the region within the image scene.

9. The method of claim 5 wherein the one and subsequent images are separated from each other by a predetermined period of time.

10. The method of claim 5 wherein the one and subsequent images are separated from each other by a predetermined number of sequential images of the plurality.

11. The method of claim 1 including the step of locating the fire in the scene based on the location of the region with the determined change in the scene.

12. The method of claim 1 wherein the step of detecting the fire includes the steps of:

identifying the region in sequential images of a predetermined period of time subsequent the one image;

comparing the identified regions of the one and sequential images to determine motion changes of the region;

calculating a motion value of the region based on said determined motion changes thereof; and determining fire of a certain type based on the motion value of the region.

13. The method of claim 12 including the step of determining a flaming fire if the motion value exceeds a predetermined threshold motion value.

14. The method of claim 12 including the step of determining a smoldering fire if the motion value is below a predetermined threshold motion value.

15. The method of claim 12 including the step of issuing an alarm based on the type of fire determined.

16. The method of claim 1 including the step of displaying the sequential plurality of infrared radiation images on a grey scale video monitor.

17. The method of claim 1 including the steps of:

identifying a plurality of regions of at least one pixel in one image of the plurality of images of the scene based on pixel values;

tracking each region of said plurality through images of the plurality subsequent said one image to determine at least one region of the plurality having a change that meets predetermined infrared radiation criteria; and detecting the fire in the scene based on the at least one region having the determined change.

18. The method of claim 17 including the step of locating fires in the scene based on the locations of the regions with the determined change in the scene.

19. The method of claim 17 wherein the step of detecting the fire includes the steps of:

calculating a motion value for each region, said motion value being calculated based on motion changes of the corresponding region through a predetermined number of sequential images subsequent the one image; and determining fire of a certain type for each region having the detected change based on the motion value of the region.

* * * * *